US008336529B2

(12) United States Patent
Nakajima

(10) Patent No.: US 8,336,529 B2
(45) Date of Patent: Dec. 25, 2012

(54) VAPOR-LIQUID SEPARATING STRUCTURE

(75) Inventor: Hirofumi Nakajima, Nagoya (JP)

(73) Assignee: Aichi Machine Industry Co., Ltd., Nagoya-shi (JP)

( * ) Notice: Subject to any disclaimer, the term of this patent is extended or adjusted under 35 U.S.C. 154(b) by 413 days.

(21) Appl. No.: 12/542,209

(22) Filed: Aug. 17, 2009

(65) Prior Publication Data

US 2010/0095922 A1 Apr. 22, 2010

(30) Foreign Application Priority Data

Oct. 20, 2008 (JP) ..... 2008-269997

(51) Int. Cl.
*F02B 25/06* (2006.01)

(52) U.S. Cl. ..... 123/572; 123/573; 123/574

(58) Field of Classification Search ..... 123/572, 123/573, 574
See application file for complete search history.

(56) References Cited

U.S. PATENT DOCUMENTS

| | | | | |
|---|---|---|---|---|
| 6,412,478 | B1 * | 7/2002 | Ruehlow et al. | 123/572 |
| 7,383,829 | B2 * | 6/2008 | Shieh | 123/572 |
| 2003/0150436 | A1 * | 8/2003 | Stegmaier et al. | 123/572 |
| 2004/0244783 | A1 * | 12/2004 | Ookawa et al. | 123/572 |
| 2005/0011503 | A1 * | 1/2005 | Deane et al. | 123/572 |
| 2005/0092267 | A1 * | 5/2005 | Nonaka et al. | 123/41.86 |
| 2005/0092268 | A1 * | 5/2005 | Girard | 123/41.86 |
| 2007/0181107 | A1 * | 8/2007 | Shieh | 123/572 |
| 2007/0215128 | A1 * | 9/2007 | Yonebayashi et al. | 123/572 |
| 2010/0126479 | A1 * | 5/2010 | Shieh et al. | 123/573 |
| 2011/0174258 | A1 * | 7/2011 | Martinsson et al. | 123/184.61 |

FOREIGN PATENT DOCUMENTS

| | | | |
|---|---|---|---|
| JP | 54-058538 | U | 4/1979 |
| JP | 60-039718 | U | 3/1985 |
| JP | S62-722 | U | 1/1987 |
| JP | 05-171916 | A | 7/1993 |
| JP | 2000-310109 | A | 11/2000 |
| JP | 2005-083268 | A | 3/2005 |
| JP | 2006-022700 | A | 1/2006 |

OTHER PUBLICATIONS

Official Communication dated Mar. 1, 2011 for the corresponding European Application No. 09010686.5.

* cited by examiner

*Primary Examiner* — Nathaniel Wiehe
*Assistant Examiner* — James Kim
(74) *Attorney, Agent, or Firm* — Global IP Counselors, LLP

(57) ABSTRACT

A vapor-liquid separating structure for an engine includes an inlet section, a discharging section, a collecting section and a vapor-liquid separating section. The inlet section is configured and arranged to take in blow-by gas from inside a valve mechanism chamber. The discharging section is configured and arranged to discharge the blow-by gas taken in through the inlet section. The collecting section is configured and arranged to collect a majority of oil entered into the vapor-liquid separating structure through the inlet section. The vapor-liquid separating section is configured and arranged to execute a vapor-liquid separation treatment with respect to the blow-by gas while guiding the blow-by gas taken in through the inlet section to the discharging section without the blow-by gas passing through the collecting section.

11 Claims, 8 Drawing Sheets

VAPOR-LIQUID SEPARATING STRUCTURE

CROSS-REFERENCE TO RELATED APPLICATIONS

This application claims priority to Japanese Patent Application No. 2008-269997, filed on Oct. 20, 2008. The entire disclosure of Japanese Patent Application No. 2008-269997 is hereby incorporated herein by reference.

BACKGROUND OF THE INVENTION

1. Field of the Invention

The present invention relates to a vapor-liquid separating structure for an internal combustion engine. More particularly, the present invention relates to a structure for separating vapor and liquid of a blow-by gas.

2. Background Information

Japanese Unexamined Utility Model Application Publication No. 62-722 UI discloses a convention internal combustion engine that uses a vapor-liquid separating structure to separate moisture and oil from blow-by gas existing inside a valve mechanism chamber. Such a vapor-liquid separating structure is provided on a head cover unit and has an inlet section, a vapor-liquid separating chamber, and a discharging section. The inlet section is formed in a baffle plate fixed to the head cover and serves to guide blow-by gas from inside the valve mechanism chamber to the vapor-liquid separating chamber. The discharging section is formed in the head cover and serves to discharge blow-by gas. The vapor-liquid separating chamber is formed by the baffle plate and the head cover.

In view of the above, it will be apparent to those skilled in the art from this disclosure that there exists a need for an improved vapor-liquid separating structure for an engine. This invention addresses this need in the art as well as other needs, which will become apparent to those skilled in the art from this disclosure.

SUMMARY OF THE INVENTION

The vapor-liquid separating structure presented in the above mentioned publication has an annular protrusion formed around a perimeter of the discharging section so that oil collected in the vapor-liquid separating chamber is not discharged from the discharging section. The protrusion prevents oil from being discharged from the discharging section. However, since a surface of the oil becomes tilted inside the vapor-liquid separating chamber when the vehicle is accelerating or traveling uphill, the oil is not readily discharged from an oil discharge outlet provided in the buffer plate. As a result, there is a possibility that oil collected in the vapor-liquid separating chamber will be discharged from the discharging section along with blow-by gas. An object of the present invention is to provide a vapor-liquid separating structure that can prevent oil collected in the vapor-liquid separating chamber from being discharged together with blow-by gas.

A vapor-liquid separating structure for an engine according to one aspect of the present invention includes an inlet section, a discharging section, a collecting section and a vapor-liquid separating section. The inlet section is configured and arranged to take in blow-by gas from inside a valve mechanism chamber. The discharging section is configured and arranged to discharge the blow-by gas taken in through the inlet section. The collecting section is configured and arranged to collect a majority of oil entered into the vapor-liquid separating structure through the inlet section. The vapor-liquid separating section is configured and arranged to execute a vapor-liquid separation treatment with respect to the blow-by gas while guiding the blow-by gas taken in through the inlet section to the discharging section without the blow-by gas passing through the collecting section.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Referring initially to FIGS. 1 to 5, a vapor-liquid separating structure for an internal combustion engine is illustrated in accordance with an embodiment of the present invention.

With the vapor-liquid separating structure according to the embodiment, since the vapor-liquid separating section is configured and arranged to guide blow-by gas from the inlet section to the discharging section without passing the blow-by gas through the collecting section, oil collected in the collecting section is not readily carried by blow-by gas when the blow-by gas is discharged from the discharging section. As a result, oil collected in the collecting section can be prevented from being discharged from the discharging section together with blow-by gas. In the following description, the term "collecting section" includes both a portion specifically intended for collecting oil and a portion in which oil collects (accumulates) but is not specifically intended for the purpose of collecting oil. The expression "main portion configured and arranged such that oil collects therein" means a portion in which a comparatively large amount of oil (a majority of oil entered into the vapor-liquid separating structure through the inlet section) collects in comparison with other surrounding portions.

A vapor-liquid separating structure according to the embodiment can prevent oil from being discharged together with blow-by gas.

General Description of Engine

Figure 1:
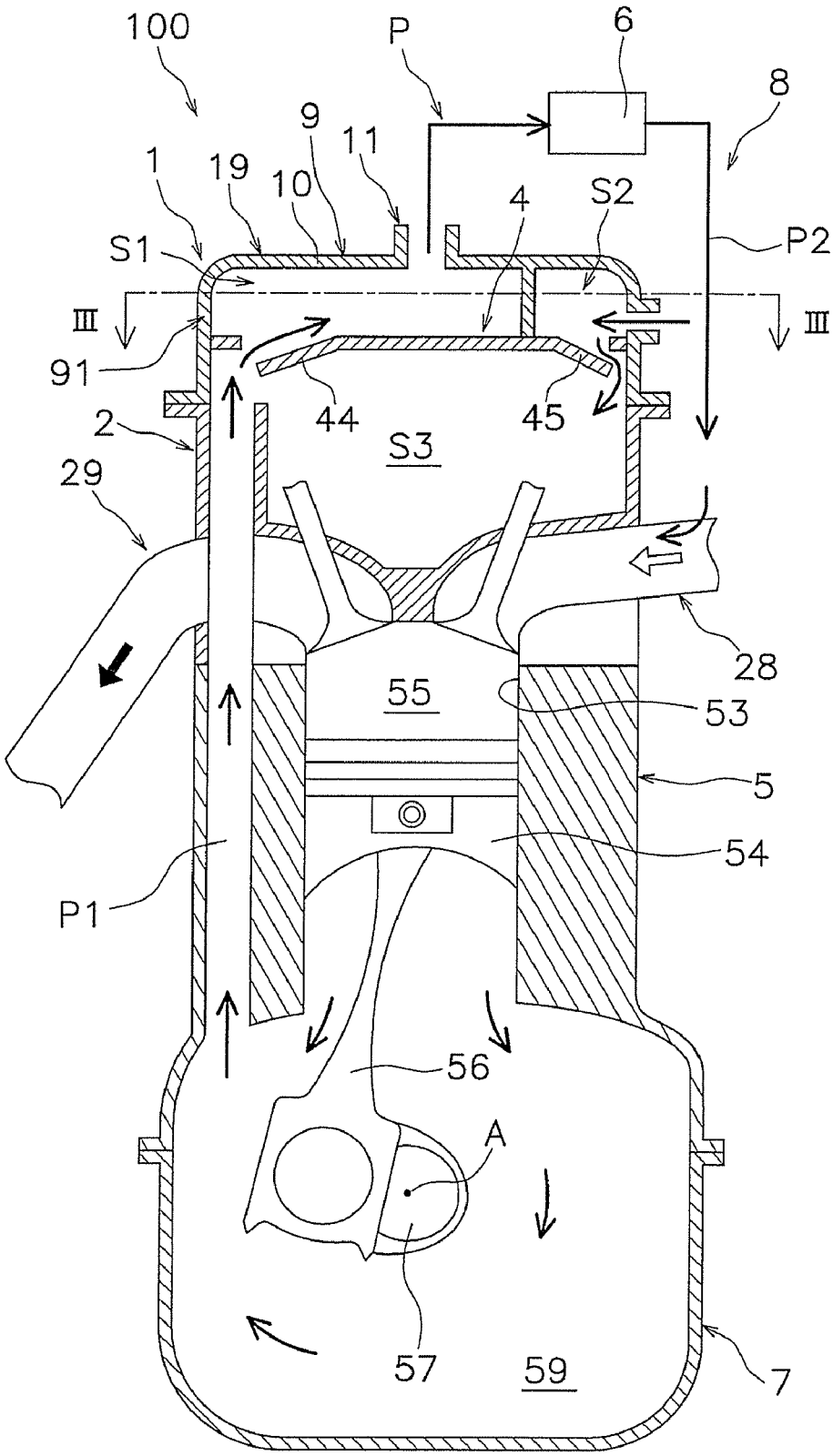
FIG. 1 is a schematic cross sectional view of an internal combustion engine equipped with a vapor-liquid separating structure according to one embodiment of the present invention.
Figure 2:
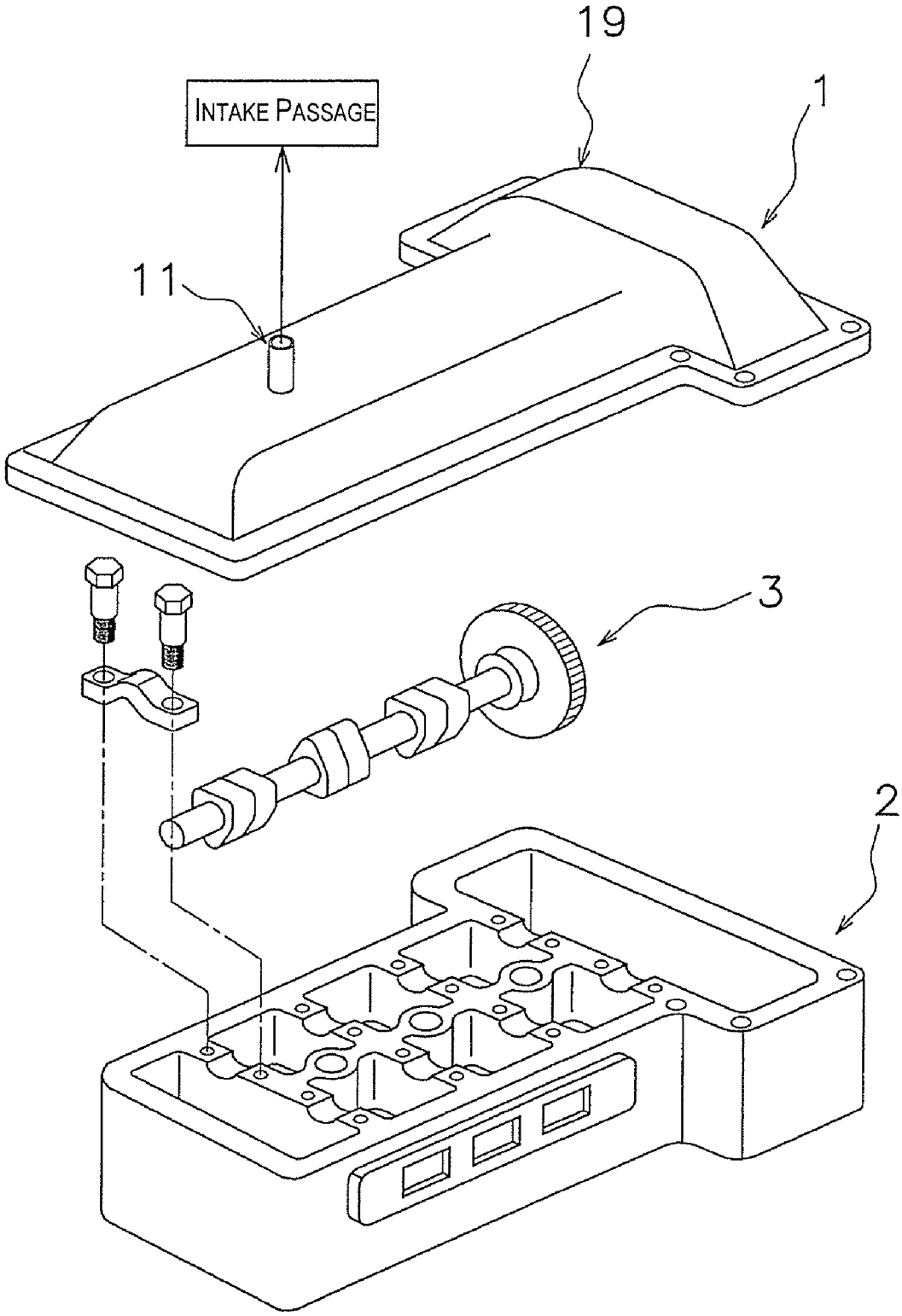
FIG. 2 is an exploded view of a head cover unit and a cylinder head of the internal combustion engine illustrated in FIG. 1.

An internal combustion engine 100 according to the embodiment will now be explained with reference to the FIGS. 1 and 2. FIG. 1 is a schematic view showing constituent features of the internal combustion engine 100. FIG. 2 is an exploded view of a head cover unit 1 and a cylinder head 2 of the engine 100. FIG. 2 only shows one camshaft 3, but there are actually two.

As shown in FIGS. 1 and 2, the internal combustion engine 100 comprises chiefly a cylinder block 5, the cylinder head 2, the head cover unit 1, and a crankcase 7. The cylinder block 5 and the crankcase 7 form a crank chamber 59 in which a crankshaft 57 is arranged. The crankshaft 57 rotates about a rotational axis A.

The cylinder block 5 has a plurality of cylinders 53. A piston 54 is movably arranged inside each of the cylinders 53. The cylinder head 2 is arranged on an upper portion of the cylinder block 5. A combustion chamber 55 is formed by each cylinder 53 and corresponding piston 54 together with the cylinder head 2. An intake passage 28 and an exhaust passage 29 connect to each of the combustion chambers 55. Each of the pistons 54 is connected to the crankshaft 57 with a connecting rod 56. The head cover unit 1 is mounted to an upper portion of the cylinder head 2. The head cover unit 1 has a head cover 19 and a baffle plate 4. The baffle plate is fixed to the head cover 19 by, for example, spot welding.

As shown in FIG. 1, the internal combustion engine 100 has an integrated blow-by gas recirculation device 8 configured to guide blow-by gas existing inside the crank chamber 59 to the intake passage 28. The blow-by gas recirculation device 8 comprises chiefly a recirculation passage P connecting the crank chamber 59 and the intake passage 28 together and a PCV valve 6 that is arranged in the recirculation passage P and serves to regulate a flow rate of blow-by gas. The recirculation passage P has a first recirculation passage P1 connecting an inlet of the PCV valve 6 to the crank chamber 59 and a second recirculation passage P2 connecting an outlet of the PCV valve 6 to the intake passage 28.

The head cover unit 1 forms a vapor-liquid separating structure 9 configured to apply a vapor-liquid separation treatment to blow-by gas.

Vapor-Liquid Separating Structure

Figure 3:
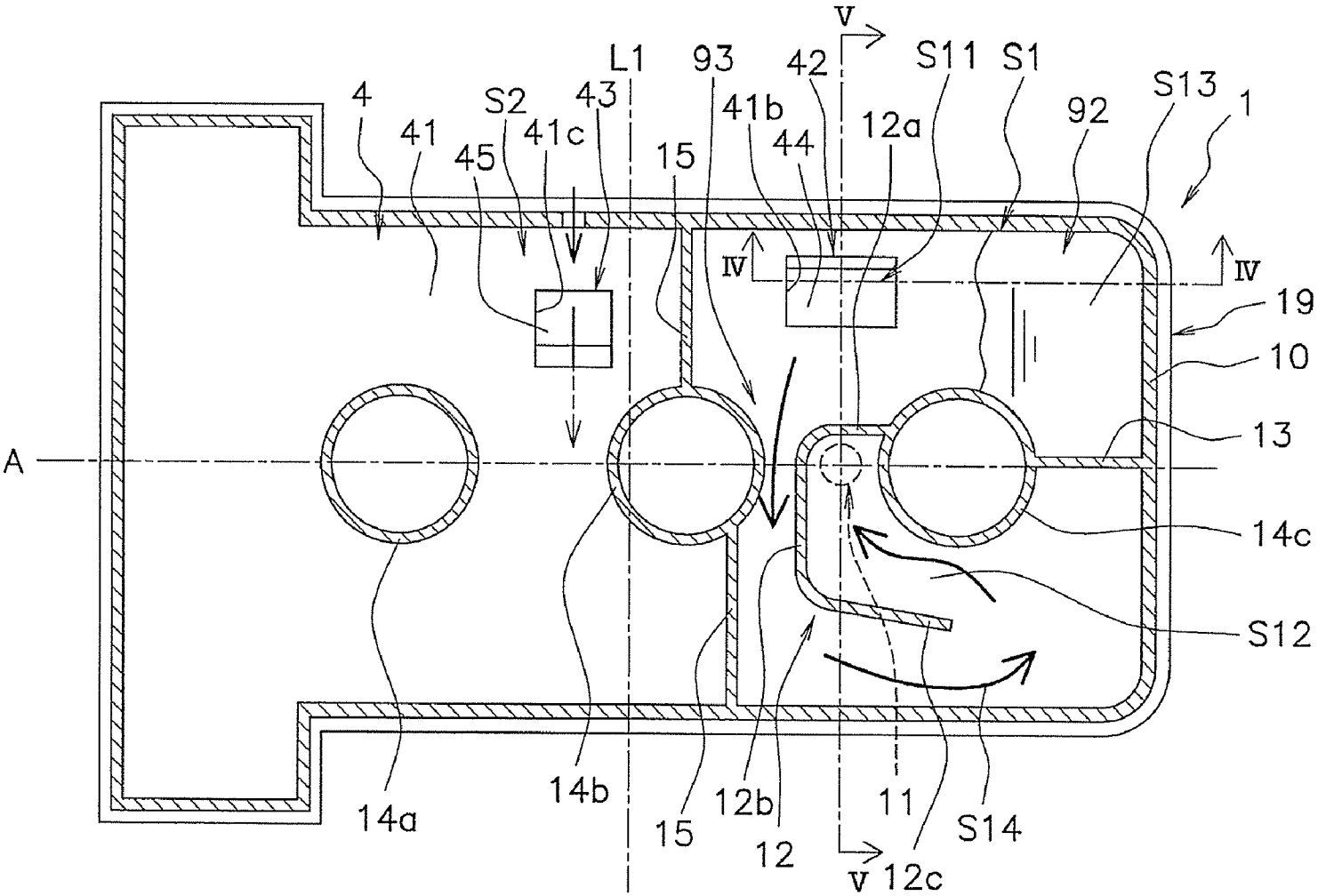
FIG. 3 is a cross sectional view of the internal combustion engine taken along a section line III-III of FIG. 1.
Figure 4:
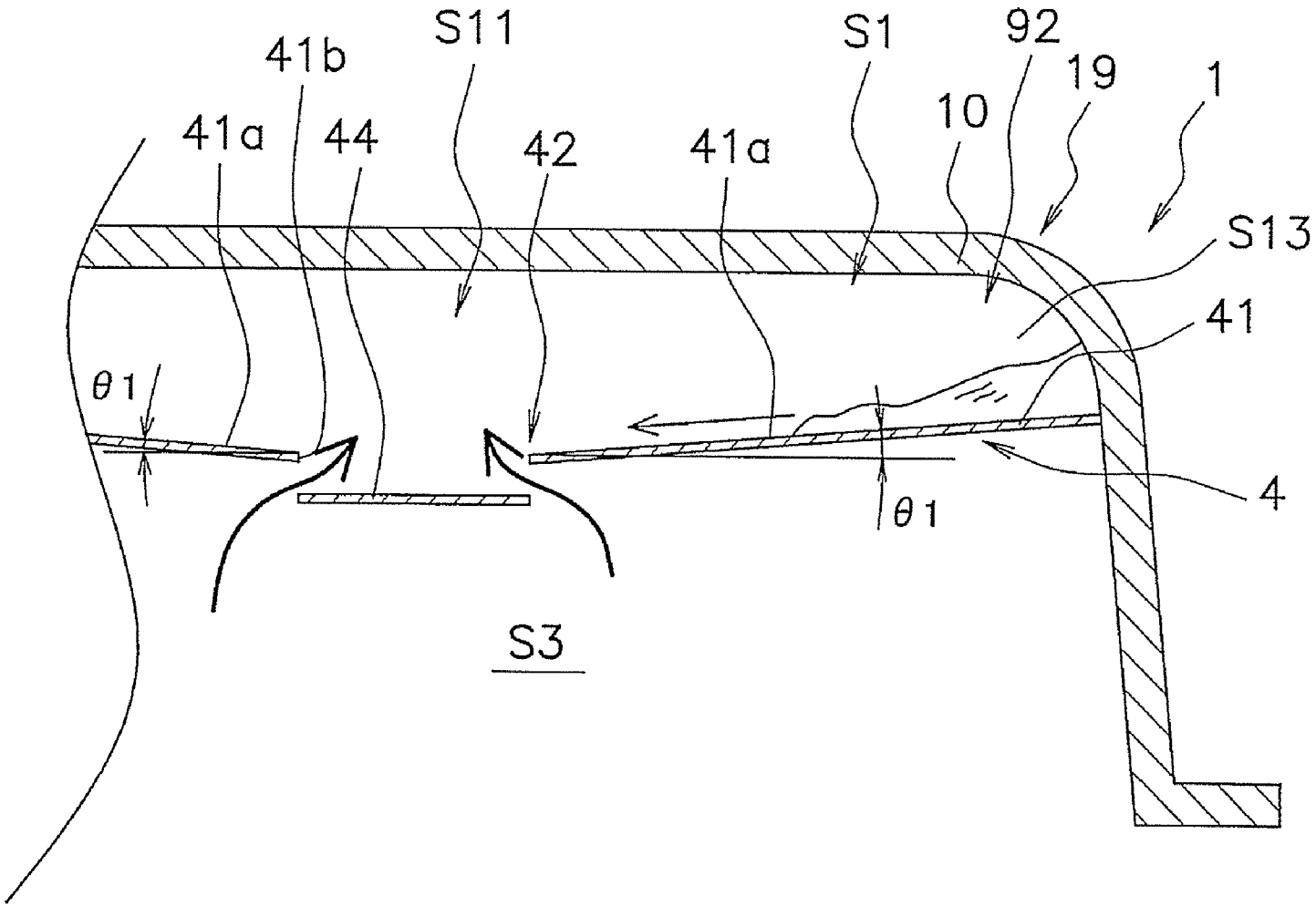
FIG. 4 is a cross sectional view of the head cover taken along a section line IV-IV of FIG. 3.
Figure 5:
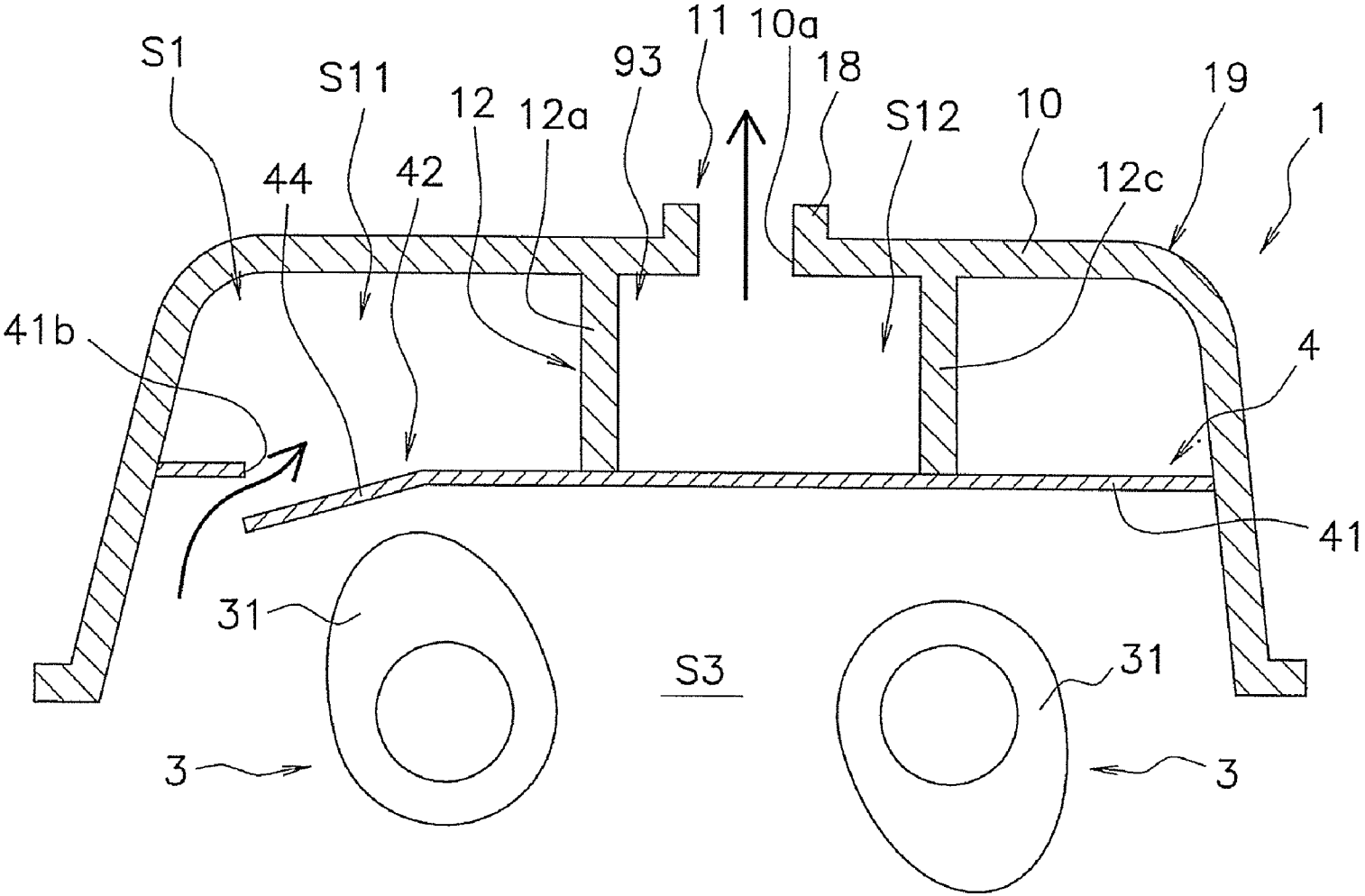
FIG. 5 is a cross sectional view of the internal combustion engine taken along the section line V-V of FIG. 3.

The vapor-liquid separating structure 9 will now be explained in detail with reference to FIGS. 1 to 5. FIG. 3 is a cross sectional view taken along the section line III-III of FIG. 1. FIG. 4 is a cross sectional view taken along the section line IV-IV of FIG. 3. FIG. 5 is a cross sectional view taken along the section line V-V of FIG. 3.

As shown in FIG. 1, the vapor-liquid separating structure 9 is contained in the blow-by gas recirculating device 8 and arranged between a valve mechanism chamber S3 and the PCV valve 6. More specifically, as shown in FIGS. 1 and 3, the vapor-liquid separating structure 9 is formed by the head cover unit 1 and comprises an inlet section 42, a collecting section 92, a vapor-liquid separating section 91, and a discharging section 11. The vapor-liquid separating section 91 has an intermediate flow passage section 93 arranged to connect the inlet section 42 and the discharging section 11 together. The collecting section 92 is arranged near the inlet section 42.

The collecting section 92 is a portion where oil collects (accumulates) but is not a portion specifically intended for collecting oil. For example, oil picked up by a cam 31 in the valve mechanism chamber S3 passes through the inlet section 42 and into the vapor-liquid separating section 91. The oil collects in the collecting section 92 due to the arrangement of the engine 100 with respect to the vehicle or due to the moving state of the vehicle.

(1) Inlet Section

The inlet section 42 is provided in the baffle plate 4. More specifically, the baffle plate 4 has a plate-like baffle plate body 41, an inlet plate 44, and a discharge plate 45. The baffle plate body 41 has a first opening 41*b* for blow-by gas to pass through and a second opening 41*c* for fresh air to pass through. The first opening 41*b* and the inlet plate 44 form the inlet section 42. The second opening 41*c* and the discharge plate 45 form a fresh air supplying section 43.

As shown in FIG. 3, the inlet plate 44 is formed as a one-piece integral unit with the baffle plate body 41 and extends into the valve mechanism chamber S3 from an edge of the first opening 41*b*. The inlet plate 44 is formed by bending a portion of the baffle plate body 41 and is arranged at a different angle than the baffle plate body 41. The inlet section 42 is arranged such that it covers the cam 31 of the camshaft 3 arranged inside the valve mechanism chamber S3. The inlet plate 44 is arranged between the first opening 41*b* and the cam 31.

As shown in FIG. 3, the discharge plate 45 is formed as a one-piece integral unit with the baffle plate body 41 and extends into the valve mechanism chamber S3 from an edge of the second opening 41*c*. The discharge plate 45 is formed by bending a portion of the baffle plate body 41 and is arranged at a different angle than the baffle plate body 41.

(2) Discharging Section

The discharging section 11 is provided in the head cover 19. More specifically, the head cover 19 has a head cover body 10 that makes up a main portion of the head cover 19. The head cover body 10 has a discharge opening 10*a* formed therein. A cylindrical pipe 18 is fixed to the head cover body 10 such that it surrounds the discharge opening 10*a*. The pipe 18 protrudes upward from the head cover 19. The discharge opening 10*a* and the pipe 18 constitute the discharging section 11. The discharging section 11 is connected to an inlet of the PCV valve 6. In this embodiment, the discharging section 11 is arranged between two cylindrical sections 14*b* and 14*c* (explained later).

(3) Vapor-Liquid Separating Section

The vapor-liquid separating section 91 is formed by the head cover 19 and the baffle plate 4. More specifically, the head cover 19 has three cylindrical sections 14*a*, 14*b*, 14*c*, two first partitioning plates 15, a second partitioning plate 13, and a flow passage forming plate 12. These parts are formed integrally with the head cover 19. In order to increase the airtightness of a vapor-liquid separating chamber S1, a seal material (e.g., a liquid sealing material) is sandwiched between contacting portions of the head cover 19 and the baffle plate 4.

The cylindrical sections 14*a*, 14*b*, and 14*c* are arranged in positions corresponding to the cylinders 53 and serve as passages through which spark plugs (not shown) can be installed, removed, and inspected. The cylindrical sections 14*a*, 14*b*, and 14*c* extend downward from an inside of the head cover body 10.

The first partitioning plates 15 are formed integrally with the middle cylindrical section 14*b* and serve to partition between the vapor-liquid separating chamber S1 and a fresh air chamber S2. The first partitioning plates 15 extend downward from an inside of the head cover body 10.

The second partitioning plate 13 is formed integrally with the cylindrical section 14*c* and serves to partition between a discharging space S12 surrounding the discharging section 11 and a collecting space S13 where a majority of oil collects. The second partitioning plate 13 extends downward from an inside of the head cover body 10.

The vapor-liquid separating chamber S1 is formed inside the vapor-liquid separating section 91. The vapor-liquid separating chamber S1 has an inlet space S11, a discharging space S12, a collecting space S13 (example of a collecting section), and an intermediate flow passage S14. The inlet space S11 is a space surrounding the inlet section 42. The discharging space S12 is a space surrounding the discharging section 11. Based on the order in which blow-by gas flows through them, the spaces are arranged in the following order: the inlet space S11, the intermediate flow passage S14, and the discharging space S12. In other words, the collecting space S13 is not arranged between the inlet space S11 and the discharging space S12.

The collecting space S13 is a space inside the collecting section 92 and functions as a main space in which oil collects. The collecting section 92 has a structure that is closed except a portion connected to the inlet section 42 (i.e., a space joining the inlet space S11). More specifically, the collecting space S13 is a space surrounded by the head cover body 10, the baffle plate body 41, the second partitioning plate 13, and the cylindrical section 14*c*. The collecting section 92 is arranged near the inlet section 42, and the collecting space S13 joins the inlet space S11.

Oil that is picked up by the cam 31 in the valve mechanism chamber S3 enters the vapor-liquid separating chamber S1 through the inlet section 42. This picked up oil and oil separated from the blow-by gas collects in the collecting section 92 (collecting space S13). A bottom surface 41*a* of the collecting section 92 is slanted downward toward the inlet section 42 such that oil collected in the collecting section 92 readily returns to the inlet section 42. As shown in FIG. 4, the bottom surface has a slant angle of, for example, θ1 with respect to a horizontal plane.

As shown in FIG. 3, the collecting space S13 is arranged in a position that is farther from a lengthwise center L1 (i.e., center as measured along the direction of the rotational axis A) of the head cover 19 than the inlet section 42. If the internal combustion engine 100 is installed in an FF (front engine, front wheel drive) vehicle, then the collecting space S13 is arranged to toward a side of the vehicle with respect to the inlet section 42. If the internal combustion engine 100 is installed in an FR (front engine, rear wheel drive) vehicle, then the collecting space S13 is arranged to toward the rear of the vehicle with respect to the inlet section 42.

The intermediate flow passage S14 is a space inside the intermediate flow passage section 93 and is arranged to join the inlet space S11 and the discharging space S12 together without passing through the collecting space S13. More specifically, the intermediate flow passage S14 is a space surrounded by the head cover body 10, the cylindrical section 14*b*, the flow passage forming plate 12, the cylindrical section 14*c*, and the first partitioning plate 15.

The flow passage forming plate 12 is a plate-like portion that is arranged around a perimeter of the discharging section 11 and serves to secure a long flow passage leading from the inlet space S11 surrounding the inlet section 42 to the discharging space S12. The flow passage forming plate 12 extends downward from the head cover body 10 and has a first portion 12*a*, a second portion 12*b*, and a third portion 12*c*.

The first portion 12*a* extends from the cylindrical section 14*c* in a direction generally parallel to the rotational axis A (lengthwise direction of the head cover 19). The second section 12*b* is arranged near the discharging section 11 and extends from an end portion of the first portion 12*a* in a direction generally perpendicular to the rotational axis A. The third portion 12*c* extends from and end portion of the second portion 12*b* in a direction generally parallel to the rotational axis A. Since the third portion 12*c* and the cylindrical section 14*c* are arranged such that a gap exists there-between, blow-by gas passes between the third portion 12*c* and the cylindrical section 14*c* as it flows toward the discharging section 11.

Blow-by gas that has flowed into the vapor-liquid separating chamber S1 from the inlet section 42 passes between the cylindrical section 14*b* and the second portion 12*b*, between the third portion 12*c* and the cylindrical section 14*c*, and is out through the discharging section 11. In this way, the blow-by gas can be made to pass through a long flow passage.

The intermediate flow passage S14 is arranged on an opposite side of the inlet section 42 as the collecting space S13. More specifically, an inlet (portion connected to the inlet space S11) of the intermediate flow passage S14 is arranged on an opposite side of the inlet space S11 as the collecting space S13. In other words, the collecting space S13 is not arranged between the inlet space S11 and the intermediate flow passage S14, i.e., the collecting section 92 is not arranged between the inlet section 42 and the intermediate flow passage section 93. Consequently, blow-by gas taken in through the inlet section 42 is guided by the intermediate flow passage S14 to the discharging section 11 without the blow-by gas passing through the collecting space S13. In other words, the blow-by gas is guided away from the collecting space S13.

Additionally, since the flow passage forming plate 12 is bent into a folded shape, the intermediate flow passage section 93 has a deep labyrinthine structure. As a result, the intermediate flow passage S14 can be provided with a long flow path length and time can be secured for a vapor-liquid separation to occur. Also, due to the labyrinthine structure, the number of folds of the intermediate flow passage section 93 can be increased such that the blow-by gas is more likely to contact the flow passage forming plate 12 and other walls. In other words, the vapor-liquid separation can be accelerated by using a labyrinthine structure.

Operation of Blow-by Gas Recirculation Device

Operation of the blow-by gas recirculation device 8 will now be explained with reference to FIGS. 1 to 5.

As shown in FIG. 1, since an outlet of the PCV valve 6 is connected to the intake passage 28, a pressure in a region peripheral to the outlet of the PCV valve 6 is lower than a pressure in a region peripheral to the inlet of the PVC valve 6. Since an opening degree of the PCV valve 6 is regulated by a balance between a spring force and the pressure difference between the inlet and outlet of the PCV valve 6, blow-by gas inside the vapor-liquid separating chamber S1 flows from the discharging section 11 into the intake passage 28.

As shown in FIG. 3, at the vapor-liquid separating chamber S1, blow-by gas from inside the valve mechanism chamber S3 flows through the inlet section 42 and into the inlet space S11. Most of the blow-by gas in the inlet space S11 flows through the intermediate flow passage S14 and into the discharging space S12 surrounding the discharging section 11, and very little of the blow-by gas in the inlet space S11 flows into the collecting space S13. Consequently, oil collected in the collecting space S13 can be prevented from flowing to the discharging space S12 along with blow-by gas. When blow-by gas flows through the intermediate flow passage S14, oil contained in the blow-by gas is separated from the blow-by gas. As a result, the oil content of blow-by gas discharged from the discharging section 11 can be lowered and, for example, sticking of the PCV valve 6 caused by oil can be prevented.

Features

Features of the vapor-liquid separating structure 9 described above will now be listed.

(1) With this vapor-liquid separating structure 9, since the intermediate flow passage S14 is configured to guide blow-by gas from the inlet section 42 to the discharging section 11 without passing the blow-by gas through the collecting space S13, oil collected in the collecting section 92 (collecting space S13) is not readily carried by the blow-by gas when the blow-by gas is discharged from the discharging section 11. As a result, oil collected in the collecting section 92 can be prevented from being discharged from the discharging section 11 together with blow-by gas.

(2) Since the intermediate flow passage S14 is arranged on an opposite side of the inlet section 42 as the collecting space S13 (collecting section 92), oil collected in the collecting section 92 can be prevented from being carried along with blow-by gas and discharged from the discharging section 11 with a simple layout.

In particular, since an inlet (space formed between the cylindrical section 14*c* and the second portion 12*b*) of the intermediate flow passage S14 is arranged on an opposite side of the inlet space S11 as the collecting space S13, oil collected in the collecting space S13 can be prevented from being discharged from the discharging section 11 along with blow-by gas.

(3) Since the intermediate flow passage S14 has a labyrinthine structure, the intermediate flow passage S14 can be made to have a long flow path length. As a result, the vapor-liquid separation treatment of the blow-by gas can be accelerated in the region where the blow-by gas flows from the inlet section 42 to the discharging section 11.

(4) Since the collecting section 92 has a structure that excludes (shuts out) everything except a portion that is connected to the inlet section 42, it is difficult for blow-by gas to flow into the collecting space S13 or pass through the collecting space S13. As a result, oil collected in the collecting section 92 is not easily carried out by blow-by gas.

(5) Since the collecting section 92 is arranged near the inlet section 42, the oil collected in the collecting space S13 returns easily to the valve mechanism chamber S3 through the inlet section 42. That is, the actual amount of oil collected in the collecting space S13 can be reduced. As a result, oil collected in the collecting section 92 can be prevented from being discharged from the discharging section 11 together with blow-by gas.

(6) Since the collecting section 92 has a bottom surface 41*a* that slants downward toward the inlet section 42, oil collected in the collecting space S13 can be returned to the valve mechanism chamber S3 through the inlet section 42 more readily. As a result, collected oil can be prevented more reliably from being discharged from the discharging section 11 together with blow-by gas.

(7) Since the inlet section 42, the discharging section 11, and the vapor-liquid separating section 91 are formed in least one of the baffle plate 4 and the head cover 19, the vapor-liquid separating structure 9 can be realized with a simple configuration.

(8) Since the inlet section 42 of the baffle plate 4 is arranged such that it covers the cam 31 of the camshaft 3, it is more difficult for oil splashed by the rotation of the cam 31 to enter the inlet section 42. In other words, with a simple configuration, the amount of oil flowing into the vapor-liquid separating section 91 through the inlet section 42 can be decreased and the amount of oil collected in the collecting section 92 can be decreased.

(9) Since the discharging section 11 is formed as an integral part of the head cover body 10, it is not necessary to add separate parts in order to provide the discharging section 11 and the discharging section 11 can be obtained using a simple configuration.

(10) Since the collecting section 92 is arranged in a position farther from a lengthwise center (i.e., center as measured along the direction of the rotational axis A) of the head cover 19 than the inlet section 42, oil can flow more readily to the collecting space S13 when the vehicle accelerates. As a result, collected oil can be prevented more reliably from being discharged from the discharging section 11 together with blow-by gas.

More particularly, if the internal combustion engine 100 is installed in an FF (front engine, front wheel drive) vehicle, then the collecting section 92 is arranged to toward a side of the vehicle with respect to the inlet section 42. Such an arrangement allows oil flowing in through the inlet section 42 to collect in the collecting section 92 more readily when the vehicle turns through a curve.

Meanwhile, if the internal combustion engine 100 is installed in an FR (front engine, rear wheel drive) vehicle, then the collecting section 92 is arranged to toward the rear of the vehicle with respect to the inlet section 42. Such an arrangement allows oil flowing in through the inlet section 42 to collect in the collecting section 92 more readily when the vehicle accelerates or travels uphill.

In short, with this embodiment, unnecessary oil can collect readily in the collecting section 92 and oil flowing in through the inlet section 42 does not easily enter the intermediate flow passage section 93.

Other Embodiments

The specific components and structure of the present invention are not limited to those described in the previous embodiment. Various changes and modifications can be made without departing from the scope of the invention as defined in the claims. In the explanations that follow, parts having substantially the same function as in the previously described embodiment will be assigned the same reference numerals and detailed explanations thereof will be omitted.

Figure 6:
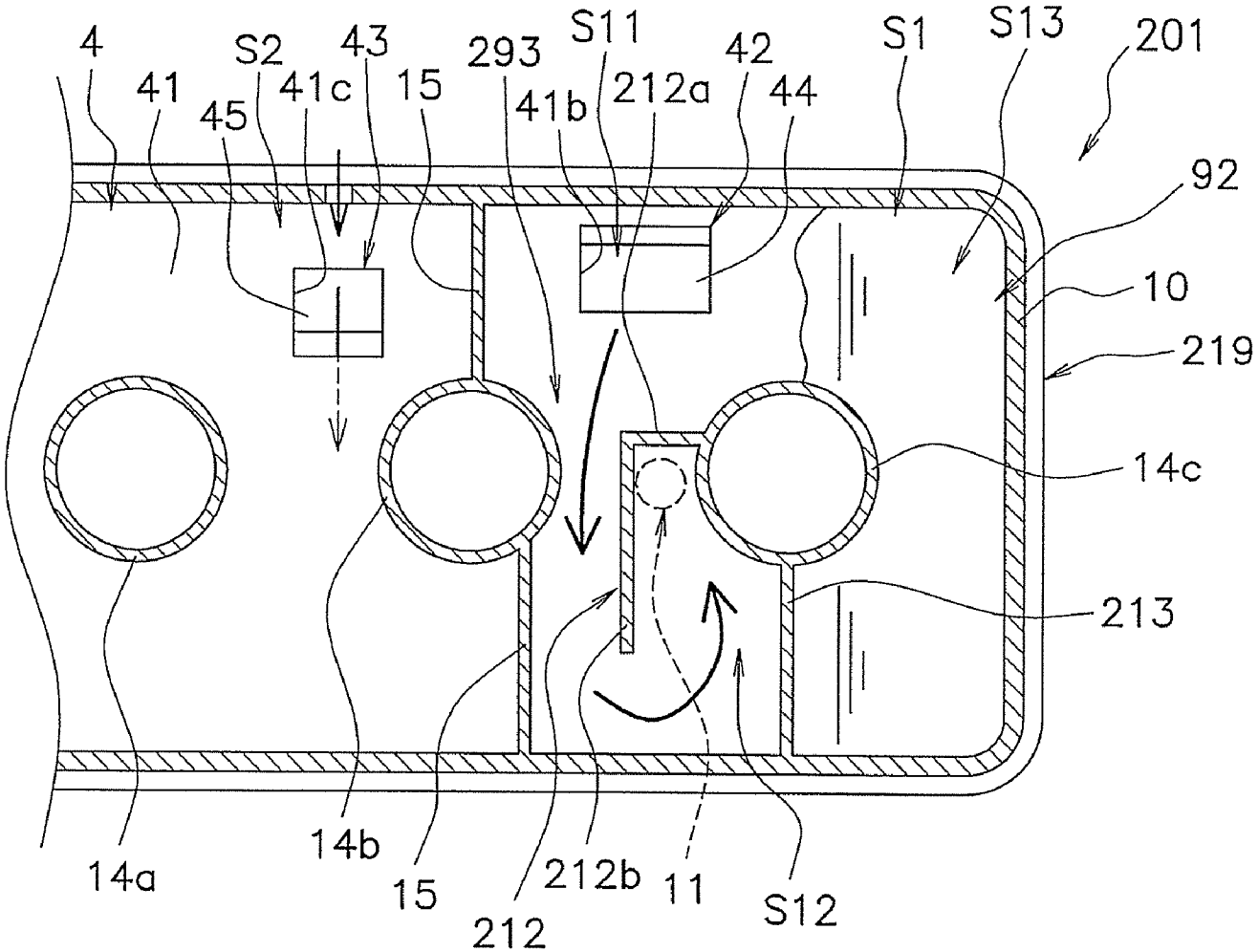
FIG. 6 is a cross sectional view of a vapor-liquid separating structure according to a modified embodiment of the present invention.

(A) In addition to the previously explained embodiment, the embodiment shown in FIG. 6 is also feasible. In the embodiment shown in FIG. 6, a head cover unit 201 has a head cover 219 and a baffle plate 4. The head cover 219 has a head cover body 10, a discharging section 11, cylindrical sections 14*a*, 14*b*, 14*c*, first partitioning plates 15, a second partitioning plate 213, and a flow passage forming plate 212.

The second partitioning plate 213 is a plate-like portion that extends from the cylindrical section 14*c* to the head cover body 10. The flow passage forming plate 212 extends from the cylindrical section 14*c* and is arranged around a perimeter of the discharging section 11. The flow passage forming plate 212 has a first portion 212*a* and a second portion 212*b*. The first portion 212*a* is a plate-like portion that extends from the cylindrical section 14*c* in a direction generally parallel to the rotational axis A. The second portion 212*b* is a plate-like portion that extends from an end portion of the first portion 212*a* in a direction generally perpendicular to the rotational axis A. The flow passage forming plate 212 differs from the flow passage forming plate 12 in that it does not have a third portion 12*c*.

With this embodiment, the length of the flow path provided by the intermediate flow passage S14 is shorter than in the head cover unit 1 of the previously described embodiment. However, since the intermediate flow passage section 293 is arranged on an opposite side of the inlet section 42 as the collecting space S13, collected oil can be prevented from being discharged from the discharging section 11 along with blow-by gas.

Figure 7:
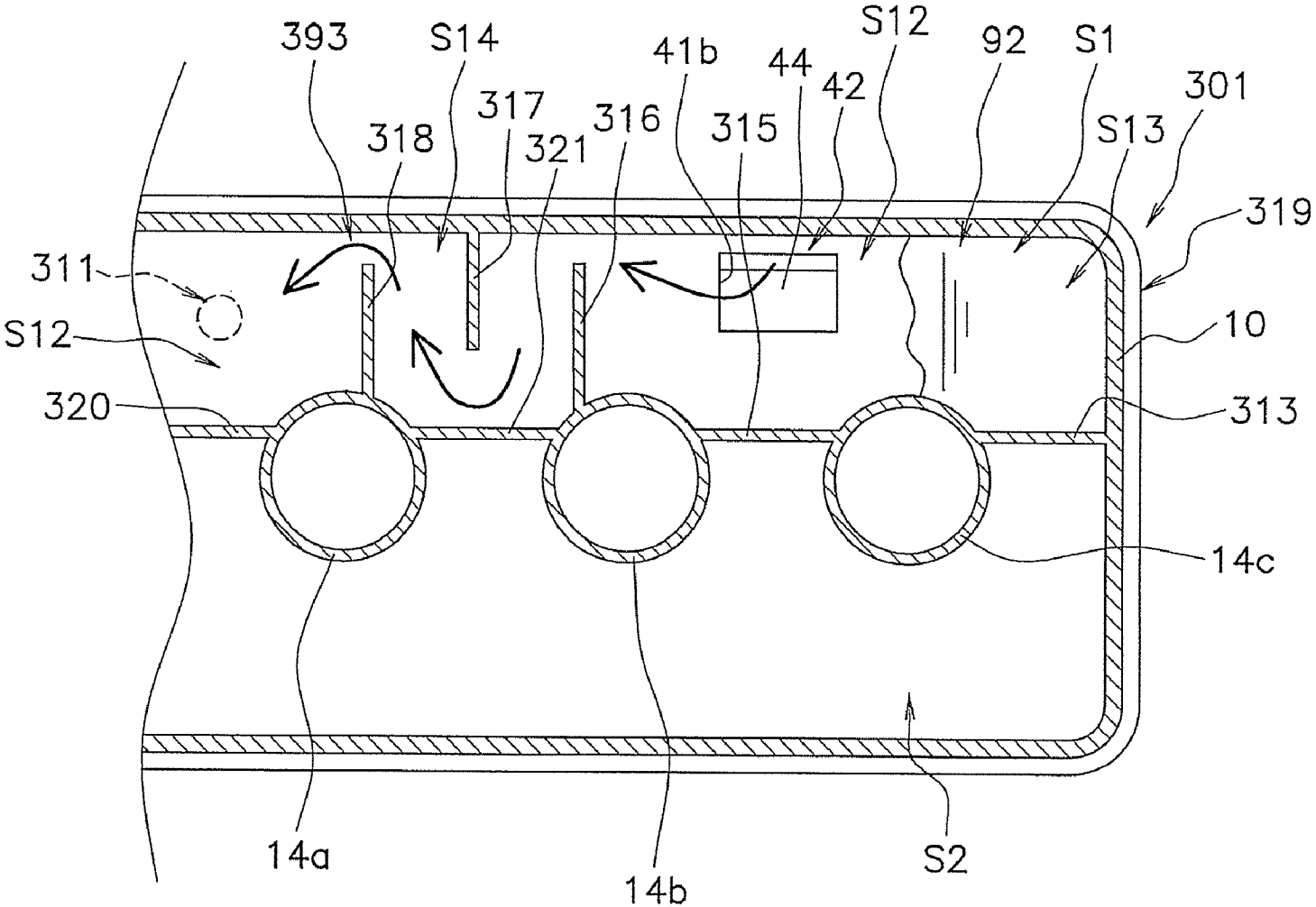
FIG. 7 is a cross sectional view of a vapor-liquid separating structure according to a modified embodiment of the present invention.

(B) In addition to the previously explained embodiment, the embodiment shown in FIG. 7 is also feasible. In the embodiment shown in FIG. 7, a head cover unit 301 has a head cover 319 and a baffle plate 4. The head cover 319 has a head cover body 10, a discharging section 311, cylindrical sections 14*a*, 14*b*, and 14*c*, a first partitioning plate 315, a second partitioning plate 313, a third partitioning plate 321, a fourth partitioning plate 320, a first flow passage forming plate 316, a second flow passage forming plate 317, and a third flow passage forming plate 318.

The discharging section 311 is arranged differently than the discharging section 11 of the previously described embodiment. Together with the cylindrical sections 14*a*, 14*b*, and 14*c*, the first partitioning plate 315, the second partitioning plate 313, the third partitioning plate 321, and the fourth partitioning plate 320 serve to partition the space between the head cover body 10 and the baffle plate 4. The first flow passage forming plate 316 is a plate-like portion that extends from the cylindrical section 14*b* in a direction generally perpendicular to the rotational axis A. The second flow passage forming plate 317 is a plate-like portion that extends from the head cover body 10 toward the third partitioning plate 321. The third flow passage forming plate 318 is a plate-like portion that extends from the cylindrical section 14*a* in a direction generally perpendicular to the rotational axis A. The first flow passage forming plate 316 is arranged such that a gap exists between an end part thereof and the head cover body 10. The second flow passage forming plate 317 is arranged such that a gap exists between an end part thereof and the third partitioning plate 321. The third flow passage forming plate 318 is arranged such that a gap exists between an end part thereof and the head cover body 10. The first flow passage forming plate 316, the second flow passage forming plate 317, and the third flow passage forming plate 318 enable the intermediate flow passage S14 between the inlet space S11 and the discharging space S12 to have a long flow path length. The intermediate flow passage section 393 has a deep labyrinthine structure.

In this embodiment, since the intermediate flow passage section 393 is arranged on an opposite side of the inlet section 42 as the collecting section 92, oil collected in the collecting section 92 can be prevented from being discharged from the discharging section 311 along with blow-by gas.

Figure 8:
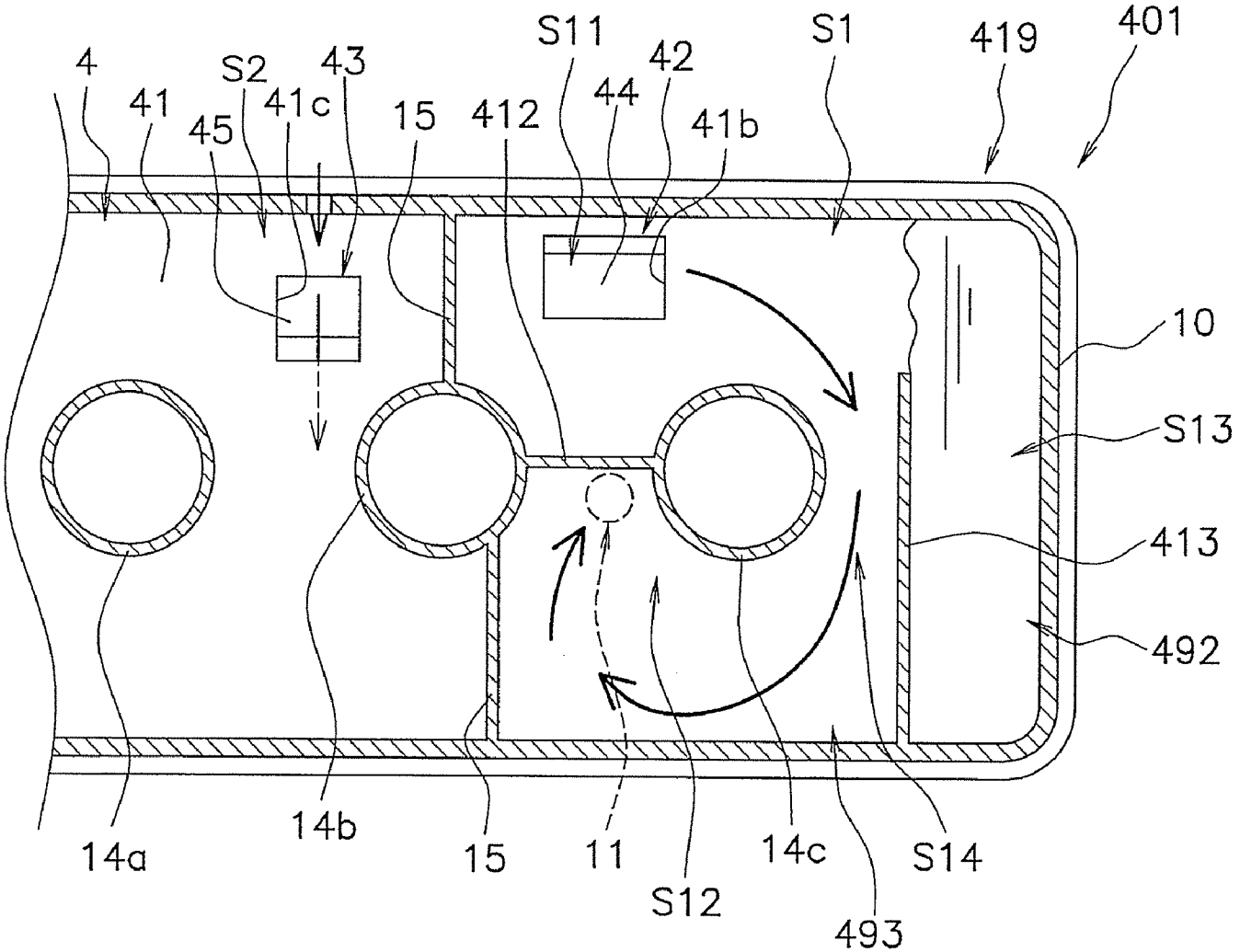
FIG. 8 is a cross sectional view of a vapor-liquid separating structure according to a modified embodiment of the present invention.

(C) In addition to the previously explained embodiment, the embodiment shown in FIG. 8 is also feasible. In the embodiment shown in FIG. 8, a head cover unit 401 has a head cover 419 and a baffle plate 4. The head cover 419 has a head cover body 10, a discharging section 11, cylindrical sections 14*a*, 14*b*, 14*c*, two first partitioning plates 15, a second partitioning plate 413, and a third partitioning plate 412.

The second partitioning plate 413 is a plate-like portion arranged on a side of the cylindrical section 14*c* and extending in a direction generally perpendicular to the rotational axis A. The second partitioning plate 413 is arranged such that a gap exists between an end part thereof and the head cover body 10. The gap is arranged to a side of the inlet section 42. A gap also exists between the second partitioning plate 413 and the cylindrical section 14*c*. The third partitioning plate 412 is a plate-like portion that joins the cylindrical section 14*b* to the cylindrical section 14*c* and is arranged between the inlet section 42 and the discharging section 11. The collecting section 492 (corresponds to the collecting section 92) is formed by the second partitioning plate 413 and the head cover body 10. The intermediate flow passage section 493 (corresponds to the intermediate flow passage section 93) is formed by the second partitioning plate 413, the cylindrical section 14*b*, the third partitioning plate 412, and the head cover body 10.

In this embodiment, too, oil collected in the collecting section 492 can be prevented from being discharged from the discharging section 11 together with blow-by gas.

(D) It is acceptable for the collecting section 92 to be a portion specifically intended to collect oil.

(E) Although in the previously described embodiment the flow passage forming plate 12 forming the intermediate flow passage section 93 is formed as an integral unit with the head cover body 10, it is acceptable for the flow passage forming plate 12 to be formed as a separate entity from the head cover body 10 or to be formed as an integral unit with the baffle plate 4.

A vapor-liquid separating structure according to the embodiments is configured to prevent oil from being discharged together with blow-by gas and is therefore applicable to the field of internal combustion engines.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional terms refer to those directions of an engine that is oriented as shown in FIG. 1. Accordingly, these terms, as utilized to describe the present invention should be interpreted relative to an engine equipped with the present invention. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vapor-liquid separating structure for an engine comprising:

an inlet section configured and arranged to take in blow-by gas from inside a valve mechanism chamber;

a discharging section configured and arranged to discharge the blow-by gas taken in through the inlet section;

a vapor-liquid separating section including an intermediate flow passage section connecting the inlet section and the discharging section together, and configured and arranged to execute a vapor-liquid separation treatment with respect to the blow-by gas while guiding the blow-by gas taken in through the inlet section to the discharging section along the intermediate flow passage section; and a collecting section arranged outside of the intermediate flow passage section, and configured and arranged to accumulate a majority of oil entered into the vapor-liquid separating structure through the inlet section, the collecting section being arranged on an opposite side from the intermediate flow passage section with respect to the inlet section as viewed in a top plan view of the engine and having a structure that is closed except for a portion connecting to the inlet section.

2. The vapor-liquid separating structure recited in claim 1, wherein the vapor-liquid separating section has a labyrinthine structure.

3. The vapor-liquid separating structure recited in claim 1, wherein the collecting section is arranged near the inlet section.

4. The vapor-liquid separating structure recited in claim 1, wherein the collecting section has a bottom surface that is slanted downward toward the inlet section when the engine is installed in a vehicle.

5. The vapor-liquid separating structure recited in claim 1, wherein the inlet section is formed in a baffle plate of the engine, the discharging section is formed in a head cover of the engine to which the baffle plate is fixed, and the vapor-liquid separating section is formed by the baffle plate and the head cover.

6. The vapor-liquid separating structure recited in claim 5, wherein the inlet section has an opening formed in the baffle plate and an inlet plate fixed to the baffle plate with the inlet plate being arranged between the opening and a cam of a camshaft disposed inside the valve mechanism chamber.

7. The vapor-liquid separating structure recited in claim 6, wherein the inlet plate is fixed to the baffle plate at a different angle than the baffle plate.

8. The vapor-liquid separating structure recited in claim 5, wherein the discharging section is formed as an integral unit with the head cover.

9. The vapor-liquid separating structure recited in claim 5, wherein the head cover has a head cover body fixed to the baffle plate, and at least one partitioning plate formed as an integral unit with the head cover body and extending from the head cover body toward the baffle plate to form a part of an intermediate flow passage section of the vapor-liquid separating section.

10. The vapor-liquid separating structure recited in claim 5, wherein the collecting section is arranged in a position farther from a lengthwise center of the head cover than the inlet section.

11. The vapor-liquid separating structure recited in claim 1, wherein the vapor-liquid separating section is configured and arranged to guide the blow-by gas away from the collecting section.

* * * * *